United States Patent [19]

Rawlings et al.

[11] Patent Number: 4,754,873

[45] Date of Patent: Jul. 5, 1988

[54] CARRIER FOR DISPLAYING A LEVEL

[75] Inventors: Eugene Rawlings, 343 Shore Dr., Ft. Myers, Fla. 33905; John D. Coleman, Philadelphia, Pa.

[73] Assignee: Eugene Rawlings, Ft. Meyers, Fla.

[21] Appl. No.: 82,530

[22] Filed: Aug. 7, 1987

[51] Int. Cl.[4] ..... B65D 25/00; B65D 25/04

[52] U.S. Cl. ..... 206/45.31; 206/349

[58] Field of Search ..... 206/45.31, 349, 44

[56] References Cited

U.S. PATENT DOCUMENTS 4,106,615 8/1978 Hiroshi ..... 206/45.31

FOREIGN PATENT DOCUMENTS 2241325 2/1974 Fed. Rep. of Germany ... 206/45.31

*Primary Examiner*—William Price

*Attorney, Agent, or Firm*—Frederick J. Olsson

[57] ABSTRACT

For a level having a pair of arms nested together but which are pivotally connected so as to be angularly separable from the nested condition and also moveable together from the separated condition to the nested condition, a hollow carrier for carrying the level constructed of flat panels one panel of which can be folded to permit the carrier to be slipped over one of the arms when the arms are angularly separated and then be refolded to provide for the separated arms to be moved into the nested condition.

5 Claims, 2 Drawing Sheets

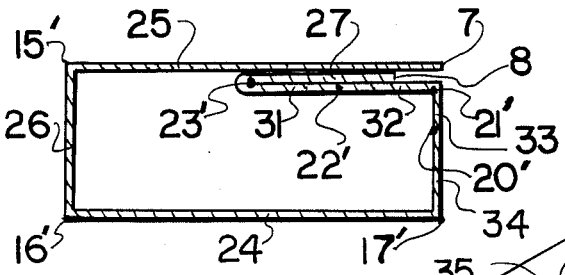
FIG. 3
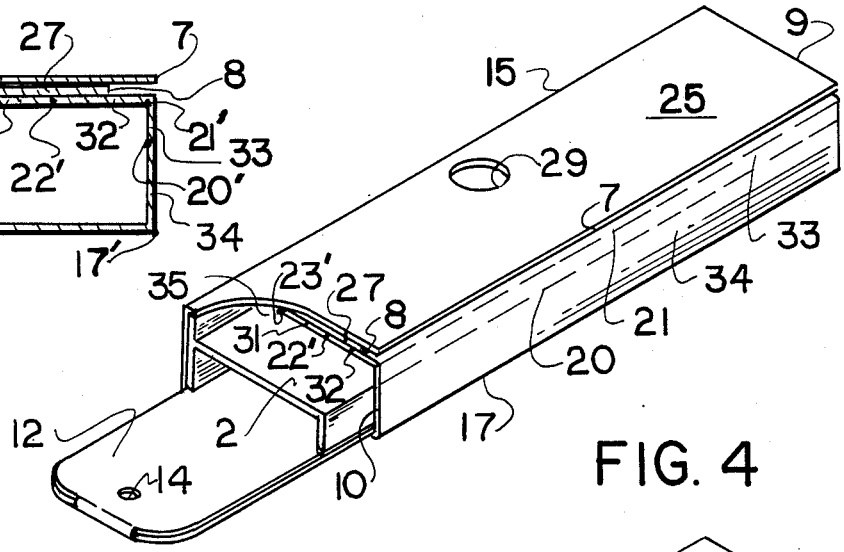
FIG. 4
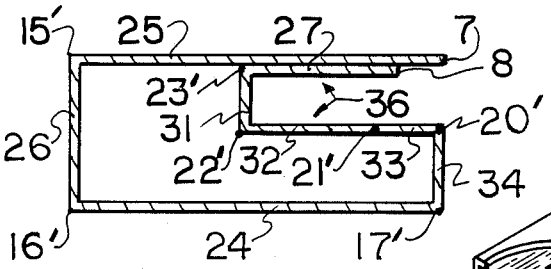
FIG. 5
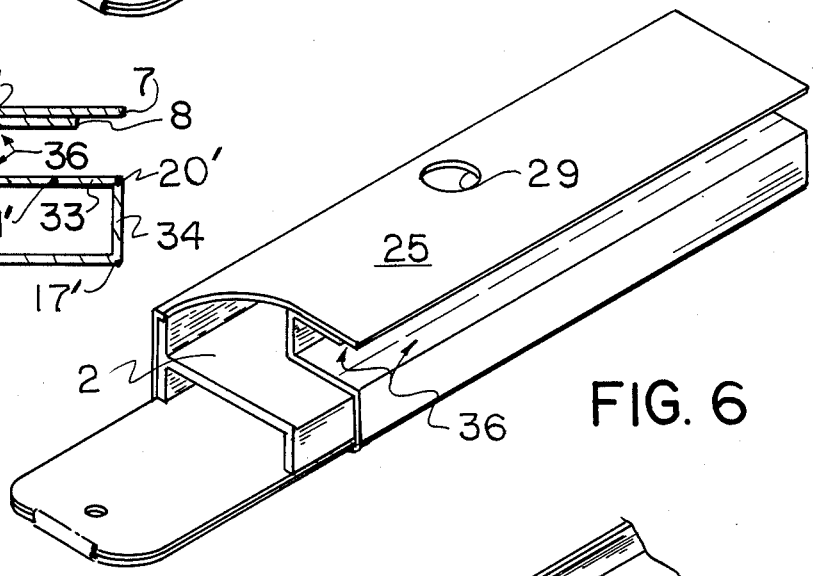
FIG. 6
FIG. 7
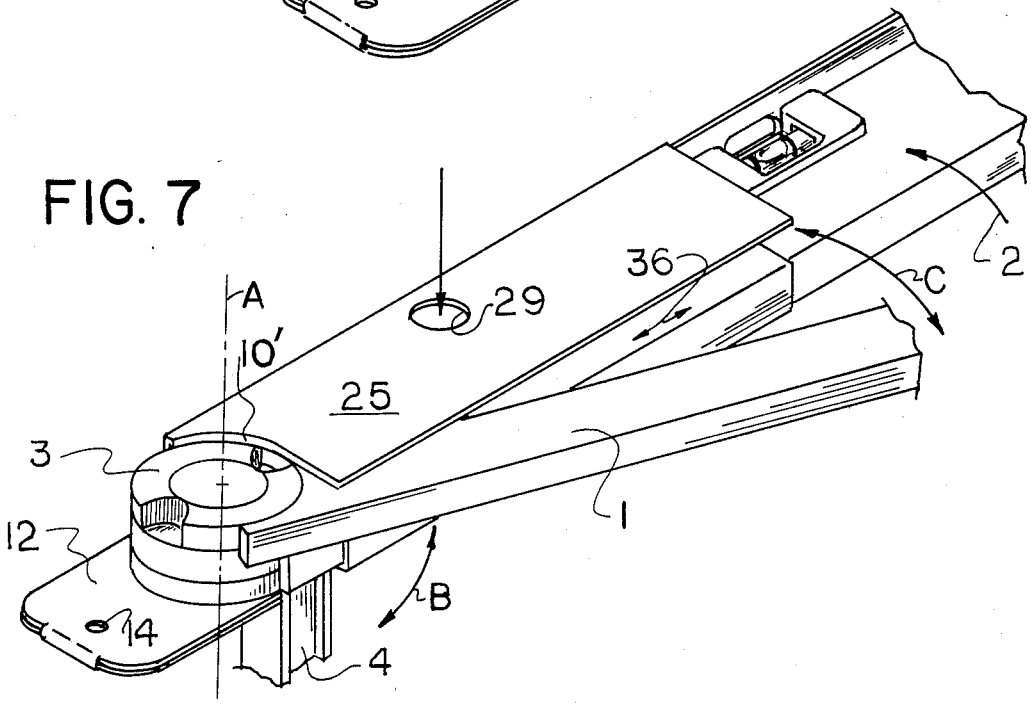

CARRIER FOR DISPLAYING A LEVEL

This invention relates to point-of-sale display devices and in particular relates to a carrier for vertically suspending a special kind of level and provides for the level to be readily seen and also provides for the level to be removed and manipulated so that its unique features can be tried out.

A level of the kind referred to is shown in U.S. Pat. No. 4,144,650 issued to Eugene Rawlings et al. This level has a pair of pivotally connected operating arms which are movable between a closed or nested position to any of a plurality of open, angularly separated positions. In any of the positions, the arms can be locked and unlocked with the flip of a locking lever. The foregoing makes the level useful for all horizontal and vertical leveling, for squaring, for mitering, and for finding the angular relationship between adjacent structural members. Reference to the patent may be had for structural details of the level.

This invention contemplates a slip-on carrier by which the level is vertically suspended from a hook for easy visual display of both the structure of the level and the various and pictorial text material on panels of the carrier. In this position, the arms are nested together which is the condition for horizontal and vertical leveling. Thus, the level can be taken off the hook and tried for such leveling. Also, the level can be taken off the hook and tried out for mitering, squaring, and angular measurement. This is accomplished by that the carrier allows the locking lever to be moved to release the arms so the same can be rotated to any angularly separated position. Thus, the leveling, mitering, squaring, and angle finding features can be demonstrated at the point of sale without removing the carrier from the level.

The invention will be described below in connection with the following drawings wherein:

FIG. 1 is a perspective view of a level as disclosed in U.S. Pat. No. 4,144,650;

FIG. 3 is a sectional, elevational view of the blank of FIG. 2 arranged in a folded condition for slipping the carrier over one arm of the level of FIG. 1;

FIG. 4 is a perspective view of the carrier as arranged in FIG. 3 being slipped in one arm of the level;

FIG. 5 is a sectional, elevational view of the carrier of FIGS. 3 and 4 after the same has been slipped over the one arm and then folded in a condition for receiving the other arm;

FIG. 6 is a perspective view of the carrier arranged as in FIG. 5 and mounted on the arm; and FIG. 7 is a perspective view of the level and carrier with the arms being separated.

Figures 1, 2:
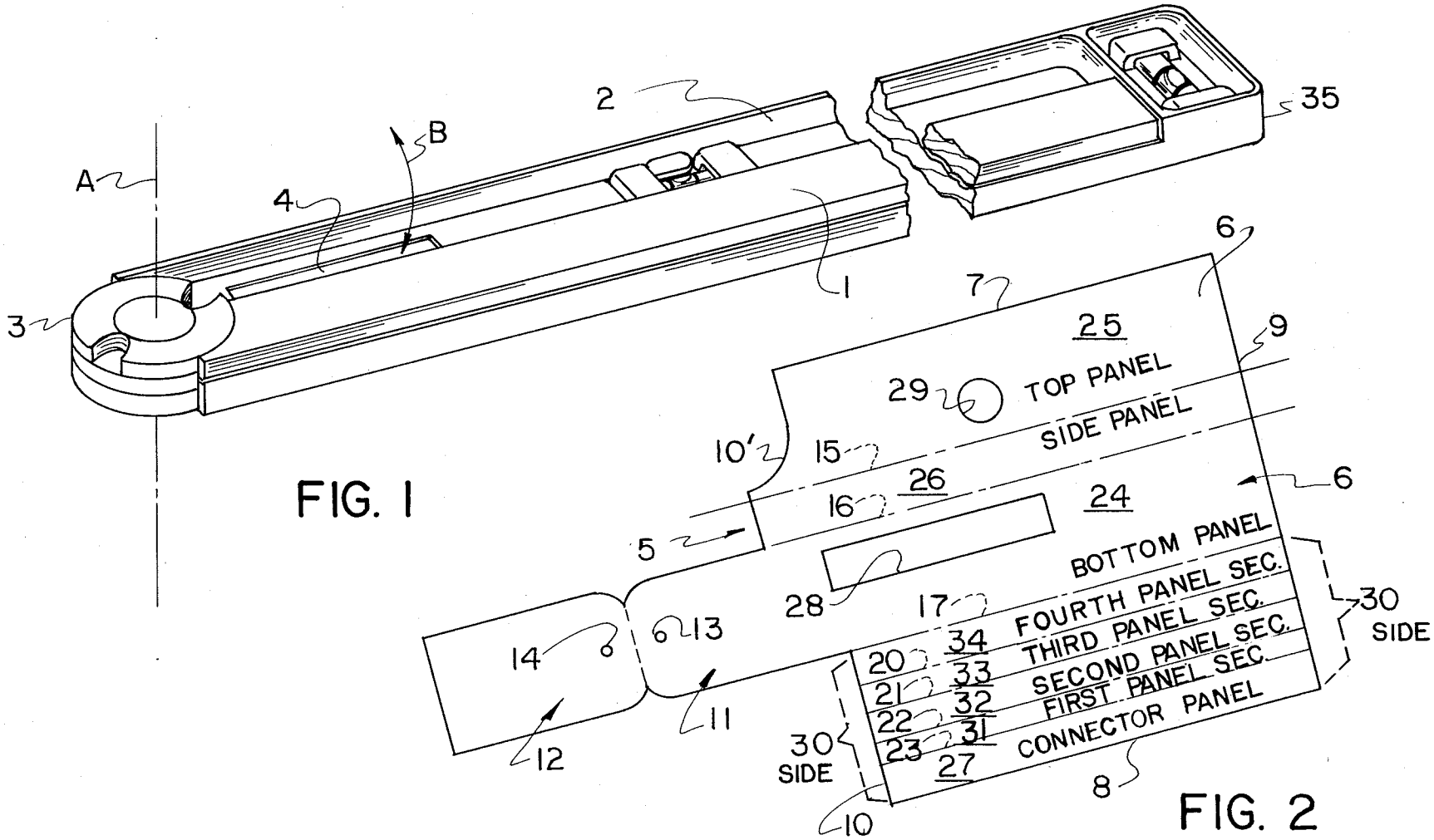
FIG. 2 is a plan view of a cut blank from which the carrier of the invention is to be formed.

Referring to FIG. 1, the level has a pair of operating arms, one being an angle arm indicated at 1 and the other being a vial or bubble arm indicated at 2. These arms are pivotally connected at the end 3 for relative rotation about the axis A (see FIG. 7). As shown, the arms are in the closed or nested position. The arms can be locked or released for rotation by rotating the locking lever 4 in the direction of the arrows B away from either side of the level. The lever 4 operates a brake mechanism.

In FIG. 2 a cut blank 5 has a generally rectangular shaped body 6 having outer edges 7 and 8 and ends 9 and 10. The end 10 has a contoured section as indicated at 10'. Tabs 11 and 12 extend out from the end 10. The tabs have openings 13 and 14. The tab 12 can be folded back onto the tab 11 and when this is done the openings 13 and 14 are in alignment. The aligned openings provide a clearance hole for the carrier and level to be hung vertically from a hook as will be more apparent later. The body 6 has score lines around which the blank will be bent to form the carrier. The bend lines are noted respectively by the dot-dash lines 15, 16, and 17. These score lines are formed and the bending accomplished by conventional tooling employed in the packaging trade.

There are other line-like areas around which the parts of the blank are bent. These line-like areas are formed by serial arranged slits as indicated at 20, 21, 22, and 23.

As will be more apparent shortly, the area between the score lines 16 and 17 forms a flat bottom panel 24, the area between the edge 7 and the score line 15 forms a flat top panel 25, the area between the score lines 15 and 16 forms a first flat side panel 26, the area between the edge 8 and the line of slits 23 forms a flat connector panel 27, the area between the score line 17 and line of slits 23 forms a second side indicated at 30.

The side 30 comprises four flat panel sections. The first panel section 31 is located between levels of slits 22 and 23. The second panel section 32 is located between the lines of slits 21 and 22. The third panel section 33 is located between the lines of slits 20 and 21. The fourth panel section 34 is located between the score line 17 and line of slits 20.

The lines of slits 20, 21, 22, and 23 make the first, second, third, and fourth panel sections easily bendable with respect to one another. Each line of slits, in effect, makes a pivotal connection. The reason for this condition will appear presently.

As will be observed, the bottom panel 24 has an elongated access opening 28 and the top panel 25 has a circular access opening 29. When the blank has been formed into the carrier as will be described, the openings 28 and 29 are in vertical alignment.

When the carrier is mounted on the level as will be described, the access openings 28 and 29 are both aligned with the locking lever 4. The opening 28 permits the locking lever 4 to be rotated out of its locking position. The opening 29 permits a finger to engage the locking lever and push it out of its locking position.

FIG. 3 shows the blank 5 as folded into a condition for slipping the carrier over the vial end 34 of the level.

In FIG. 3, the score line 15 is indicated at 15', the score line 16 at 16', and the score line 17 at 17'. The positions of the lines of slits 20, 21, 22, and 23 are indicated respectively at 20', 21', 22', and 23'. For each reference, an enlarged dot has been placed at the positions indicated at 20'–23'.

The connector panel 27 engages the top panel 25 and is adhesively secured thereto. The bottom panel 24 and the top panel 25 are parallel to one another. The side panel 26 is normal to the top and bottom panels. The first and second panel sections 31 and 32 are coplanar and parallel with the top panel 25. The panel sections 33 and 34 are coplanar and are parallel to the side panel 26.

When the carrier has been bent as noted in connection with FIG. 3, the tab 12 is folded back on the tab 11.

The carrier is now ready to be slipped over the vial end 34. This is done by first depressing the locking lever 4 to unlock the lever arm 1. Then the lever arm is swung away from the bubble arm 2 to preferably the 180° position and then the lower arm moved back to its locking position. As shown in FIG. 4, the carrier is now slipped over the bubble arm 2, at the vial end 34, and moved toward the end 3 of the level. This motion is continued until the contoured edge 10' is at the end 3 as shown in FIG. 7.

The carrier is now ready for the side 30 to be bent to condition the carrier to permit the angle arm 1 to be rotated back to the nested position. The latter condition of the carrier is shown in FIG. 4 and is attained simply by pushing inwardly on the line of slits 21. In FIG. 5, it will be seen that the first panel section 31 extends parallel to the side panel 26 and that the second and third panel sections 32 and 33 are coplanar and parallel to the top panel 25. The foregoing arrangement forms the elongated cavity 36 to receive the angle arm 1. The condition of the carrier of FIG. 5 is very clearly shown in FIG. 6 especially the setup of the cavity 36.

As will be evident from an inspection of FIG. 7, the cavity 36 provides for the angle arm to be moved out of and into its locking position with motion as indicated by the arrow C.

When the angle arm 1 is in the nested position, the carrier and level are secured together and this provides for the carrier to support the level when the carrier is suspended with a hook.

We claim:

1. A display carrier for a level, the carrier comprising an elongated hollow body having a top panel, a bottom panel parallel to the top panel, a first side panel connecting the top and bottom panels and being normal thereto, and a second side panel connecting the top and bottom panels, the second side panel comprising first, second, third, and fourth panel sections, the first panel section being pivotally connected to the top panel and also pivotally connected to the second panel section, the second panel section also being pivotally connected to the third panel section, the third panel section also being pivotally connected to the fourth panel section and the fourth panel section also being connected to the bottom panel and the said pivotal connections providing for:

(a) a first condition wherein the first and second panel sections are co-planar and are parallel with the top panel and the third and fourth panel sections are coplanar and parallel to the first side panel; and (b) a second condition wherein the first and fourth panel sections are respectively parallel to the first side panel and the second and third panel sections are parallel to the top panel.

2. The display carrier of claim 1 wherein the bottom panel has an elongated access opening and the top panel has an access opening in vertical alignment with the elongated opening.

3. The carrier of claim 1 where each of said pivotal connections is formed as by serially arranged slits between the adjacent panel sections.

4. The carrier of claim 1 further including:

an extention extending away from the bottom panel and comprising first and second tabs, the first tab being connected to the bottom panel and the second tab being connected to the first tab and foldable back onto the first tab; and openings respectively in the first and second tabs arranged to be in alignment when the first tab is folded back on the second tab, the aligned openings being for use in receiving a hook.

5. For a level having a pair of arms nested together but which are pivotally connected so as to be angularly separable from the nested condition and also moveable together from the separated condition to the nested condition, a hollow carrier for carrying the level constructed of flat panels one panel of which can be folded to permit the carrier to be slipped over one of the arms when the arms are angularly separated and then be refolded to provide for the separated arms to be moved into the nested condition.

* * * * *